US005120059A

United States Patent [19]

Oursler

[11] Patent Number: 5,120,059

[45] Date of Patent: Jun. 9, 1992

[54] ROTARY SERIAL PLAY FEATURE

[75] Inventor: Barry Oursler, Barrington, Ill.

[73] Assignee: Williams Electronics Games, Inc., Chicago, Ill.

[21] Appl. No.: 648,198

[22] Filed: Jan. 31, 1991

[51] Int. Cl.[5] ..... A63F 7/30

[52] U.S. Cl. ..... 273/121 A; 273/118 A; 273/118 D; 273/120 A

[58] Field of Search ..... 273/118 R, 118 A, 118 D, 273/119 R, 119 A, 120 R, 120 A, 121 R, 121 A, 121 B, 122 R, 122 A, 123 R, 123 A; 446/168, 170, 171

[56] References Cited

U.S. PATENT DOCUMENTS

| | | | |
|---|---|---|---|
| 3,108,810 | 10/1963 | Wiley, Jr. | 273/120 R |
| 3,592,471 | 7/1971 | Swimmer et al. | 273/120 R |
| 4,055,342 | 10/1977 | Matsumoto | 273/121 R |
| 4,395,041 | 7/1983 | Goldfarb et al. | 273/119 A |

*Primary Examiner*—William H. Grieb
*Assistant Examiner*—Raleigh W. Chiu
*Attorney, Agent, or Firm*—Rockey & Rifkin

[57] ABSTRACT

A play feature for a pinball game having a plurality of wheels rotatable about a horizontal axis and having a plurality of ball receiving sockets formed therein. Each wheel can pick up a pinball from a first position on the playfield and after rotating through approximately 180 degrees discharge the pinball at a second position on the playfield. The wheels are arranged in a series whereby the discharge position of the upstream wheel corresponds to the pick up position of the downstream wheel. In this manner the pinball can be conveyed across the playfield in a stepped fashion as it is transferred from the upstream wheel to the downstream wheel. The rotation of the wheels is coordinated by using a single drive motor operatively connected to each of the wheels by a transmission member. Finally, downfield wheels can be arranged at different elevations relative to the playfield such that the pinball can be raised or lowered relative to the playfield by the successive wheels as the pinball is conveyed across the playfield.

10 Claims, 1 Drawing Sheet

ROTARY SERIAL PLAY FEATURE

BACKGROUND OF THE INVENTION

The invention relates, generally, to amusement devices and, more particularly, to a play feature for a pinball game.

Pinball games, as is well known, consist, generally, of a slanted playfield and a plurality of diverse play features arranged on the playfield. A player uses flippers to direct a rolling pinball at desired ones of the play features thereby to score points.

The players if pinball games are selective as to the machines they choose to play and base their selections on the various types of play feature schemes offered. Therefore, the popularity of a manufacturer's line of pinball games resides in its ability to appeal to the players by offering new and different play features.

One known play feature consist of a wheel that rotates about a horizontal axis and has sockets for receiving a pinball. The play feature operates similarly to a ferris wheel in that the pinball enters one of the sockets at a first location on the playfield, the wheel rotates through approximately 180 degrees and the pinball is deposited back onto the playfield at a second location. While such a rotary play feature is entertaining, the movement of the pinball is limited to the 180 degrees of rotation of the single wheel.

OBJECTS OF THE INVENTION

It is a general object of the invention to provide a new and improved pinball game play feature.

It is another object of the invention to provide an improved play feature that can move the pinball through a series of interrelated steps.

It is a further object of the invention to provide an improved play feature that is inexpensive to manufacture yet is durable enough to withstand repetitive cycles of play.

Other objects of the invention, in addition to those set forth above, will become apparent to one of ordinary skill in the art from the following description of the invention.

SUMMARY OF THE INVENTION

The invention consists of a plurality of wheels rotatable about a horizontal axis and having a plurality of ball receiving sockets formed therein. Each wheel can pick up a pinball from a first position on the playfield and after rotating through approximately 180 degrees deposit the pinball at a second position on the playfield. The wheels are arranged in series whereby the discharge position of the upstream wheel corresponds to the pickup position of the downstream wheel. In this manner the pinball can be conveyed across the playfield as it is transferred from the upstream wheel to the downstream wheel. The rotation of the wheels is coordinated by using a single drive motor operatively connected to each of the wheels by a transmission member. Finally, the wheels can be arranged at slightly different elevations such that the pinball is lifted and/or lowered relative to the playfield as the pinball is transferred from wheel to wheel.

DETAILED DESCRIPTION OF THE INVENTION

Figure 1:
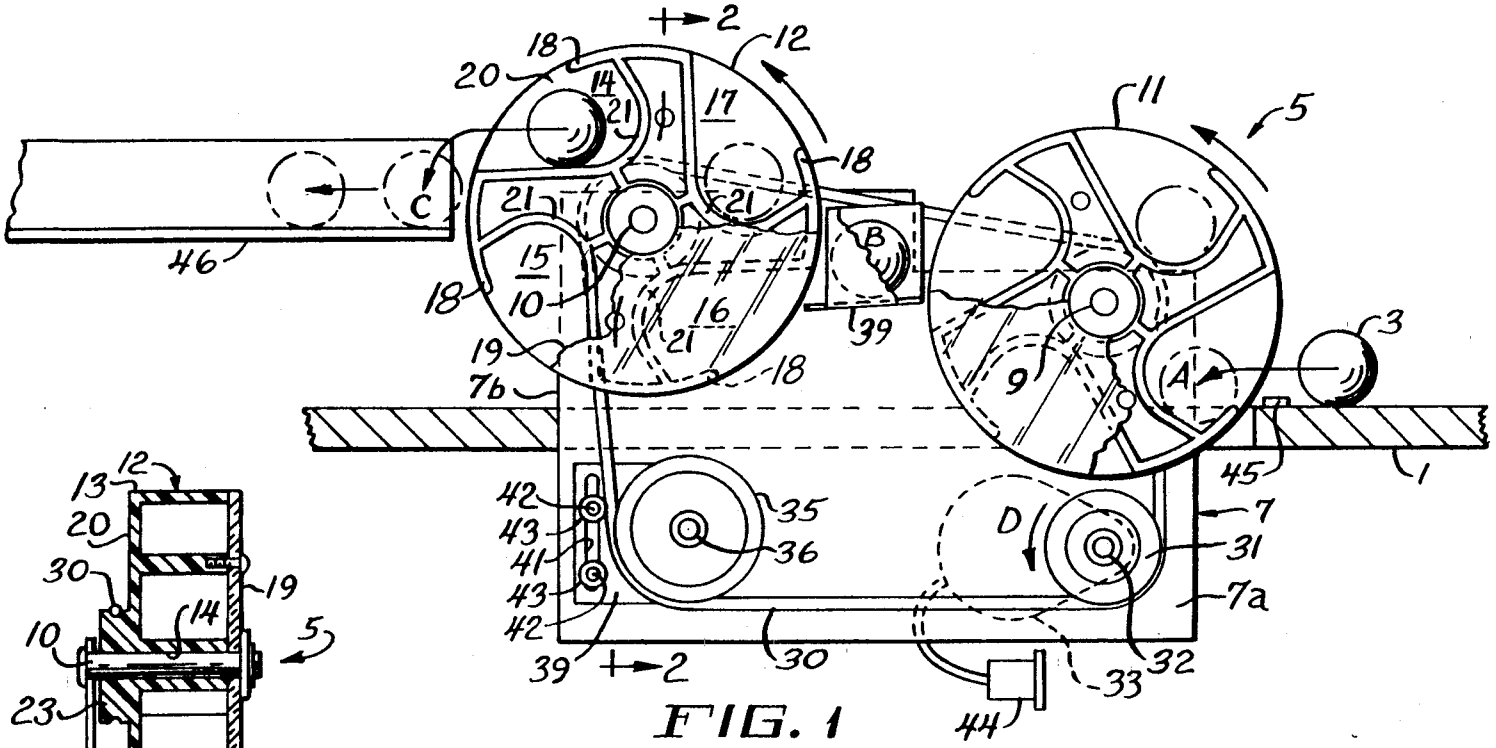
FIG. 1 is a side front of the play feature of the invention.
Figure 3:
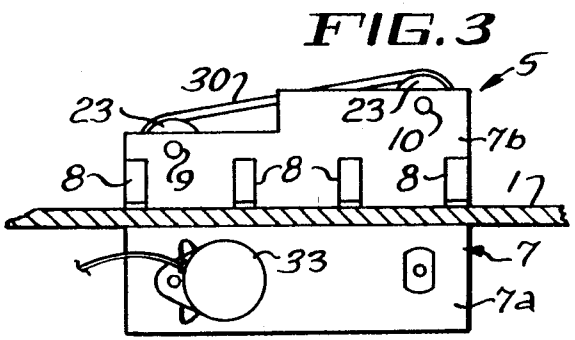
FIG. 3 is a back view of the play feature of the invention.

Referring more particularly to the Figures, the inclined playfield 1 of a pinball game is shown supporting a pinball 3. The play feature of the invention is shown, generally, at 5 and includes a frame 7 connected to playfield 1 via L-shaped brackets 8. Frame 7 consists of a rigid plate extending substantially perpendicular to playfield 1 and having a upper portion *7a* extending above playfield 1 and a lower portion *7b* extending below playfield 1.

Pivotably supported on upper portion *7a* of frame 7 by shafts 9 and 10 are a first upstream wheel 11 and a second downstream wheel 12, respectively. While two wheels are shown, it is to be understood that the playfield of the invention encompasses the use of additional wheels. The structure of wheels 11 and 12 are identical such that specific reference will be made only to wheel 12. Wheel 12 consists of an opaque portion 13 molded from a rigid plastic material and having an aperture 14 for receiving shaft 10. Four pinball receiving socket 14–17, defined by back wall 20 and curved bottom walls 21, are formed at 90 degrees intervals around the periphery of portion 13. A lip 18 is provided along the trailing edge of each of the sockets 14–17 to prevent the pinball from inadvertently falling from the sockets. A transparent cover plate 19 is provided over the face of wheel 11 to form the front wall of sockets 14–17. The front wall is made transparent to allow the player to observe the movement of the ball within the play feature. Finally, Wheel 12 includes a pulley 23 integrally formed with back wall 20, best shown in FIG. 2. Pulley 23 is formed concentrically with shaft 9 and cooperates with the drive belt 30 to provide the rotary motion of the wheels as will hereinafter be described.

Drive pulley 31 is rotatably mounted on lower section *7b* of frame 7 via shaft 32. A drive motor 33 is also mounted on section *7b* and is connected to drive pulley 31 via a suitable transmission member, for example a belt, chain or gear, such that when motor 33 is activated, drive pulley 31 is rotated in the direction of arrow D.

Also mounted on lower section *7b* is an adjustable pulley 35. Pulley 35 is rotatably mounted on shaft 36 which is mounted on flange 39. Flange 39 includes a slot 41 engageable by screws 42 and nuts 43 such that when the nuts are tightened against flange 39 shaft 36 will be fixed in position relative to frame 7.

A flexible drive belt 30 extends around drive pulley 31, adjustable pulley 35 and the pulleys 23 formed on wheels 11 and 12 such that the rotation of drive pulley 31 will result in the simultaneous rotation of wheels 11 and 12. Adjustable pulley 35 is made movable relative to frame 7 by the slot and screw connection to allow the tension in drive belt 37 to be increased or decreased as desired. It should be noted that either a drive chain engageable with sprockets o drive shaft engageable with gears could be used in place of the drive belt and pulleys show in the illustrated embodiment.

The drive motor 33 is connected to the pinball games microprocessor by connector 44 such that the play feature can be activated as directed by the game's program. While the play feature can be activated as desired by the game program, in a preferred embodiment, a microswitch or sensor 45 located at the entrance to the upstream wheel 11 will indicate the presence of the pinball and will direct the microprocessor to initiate activation of drive motor 33.

Located between the wheels 11 and 12 is a ramp 46 angled slightly downwardly in the direction the upstream wheel 11 to the downstream wheel 12. Ramp 39 serves to move the pinball as it is discharged from the upstream wheel 11 to a point where it can be picked up by the downstream wheel 12 under the force of gravity.

In operation, the play feature 1 assumes the rest position shown in FIG. 1. When a pinball activates sensor 45 upon entering the exposed socket (or as otherwise directed by the same program) the microprocessor will activate motor 33. Motor 33 will in turn rotate drive pulley 31, the motion of which will be transmitted to wheels 11 and 12 via flexible drive belt 30. As wheel 11 rotates the pinball will be picked up (position A) and discharged on to ramp 39 (Position B). Because ramp 39 is inclined downwardly the pinball will roll into the exposed socket of rotating wheel 11 and will be deposited on discharge ramp 46 (Position C) thereby completing one cycle of operation. Once the pinball has been deposited on ramp 46, motor 33 will be deactivated and the play feature will assume its rest position until it is again activated by the game's microprocessor.

Figure 2:
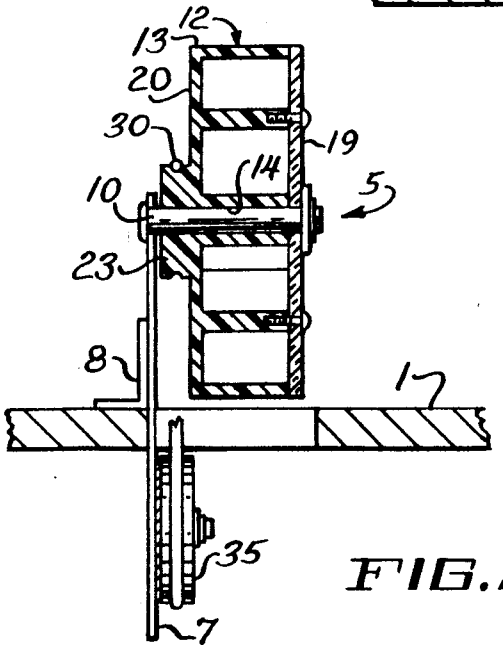
FIG. 2 is a section view of the feature of the invention taken along line 2-2 of FIG. 1.

In the preferred embodiment, described with specific reference to FIGS. 1 and 2, the downstream wheel 12 is located at a higher elevation than the upstream wheel 11 such that the pinball exits the play feature at a higher level than it started. This permits the use of ramps or an elevated playfield at the discharge end. In this manner, the play feature of the invention conveys the pin ball laterally across the playfield and elevates the pinball in a series of steps. While two wheels are shown in the preferred embodiment, a greater number could be used such that the pinball could be laterally conveyed or elevated over any desired distance. Moreover, the wheels could all be located at the same elevation or the downstream wheels could be located lower than the upstream wheels such that the play feature could be used either to convey the pinball without any change in elevation or to convey the pinball while lowering its elevation, respectively.

While the invention has been described in some detail, it is to be understood that this description is offered merely by way of example and that the invention is to be limited in scope only by the appended claims.

What is claimed is;

1. A pinball game comprising:

(a) an inclined playfield for supporting a rolling ball and a plurality of play features;

(b) one of said plurality of play features comprising:

(1) a first ball engaging means movably supported adjacent to the playfield for picking up the rolling ball at a first location on the playfield and discharging the ball at a second location;

(2) a second ball engaging means movably supported relative to the playfield for picking up the ball at the second location and discharging it at a third location remote from the first location;

(3) means for sensing the presence of the ball in the first position and for generating a signal in response thereto;

(4) means for moving the first and second ball engaging means relative to the playfield in response to said signal; and (5) means for coordinating the rotation of said first and second ball engaging means to provide synchronous operation therebetween;

whereby the ball is moved over the playfield by the first and second ball engaging means.

2. The playfield feature according to claim 1, wherein said first and second ball engaging means comprise wheels supported for rotary movement about a horizontal axis and having at least one ball receiving means.

3. The playfield feature according to claim 2, wherein said wheels each include four ball receiving means located at 90 degree intervals about the periphery of the wheels.

4. The playfield feature according to claim 2, wherein said wheels include a transparent portion whereby the pinball is visible while in the ball receiving means.

5. The playfield feature according to claim 1, wherein said means for coordinating includes a transmission member for transmitting the rotary motion to said first and second ball engaging means.

6. The playfield feature according to claim 5, wherein said transmission member comprises a drive belt engageable with pulleys connected to said first ball engaging means, said second ball engaging means, and said means for rotating.

7. The playfield feature according to claim 6, further including an adjustably mounted pulley engageable with said drive belt whereby a change in the position of the adjustably mounted pulley changes the tension on the drive belt.

8. The playfield feature according to claim 1, further including an inclined ramp defining said second location whereby when said ball is discharged from the first ball engaging means it rolls under the force of gravity to said second ball engaging means.

9. The playfield feature according to claim 1, further including a frame for supporting said first and second ball engaging means.

10. The playfield feature according to claim 1, wherein said first and second ball engaging means are located at different elevations.

* * * * *